US007765850B2

(12) United States Patent
Arita et al.

(10) Patent No.: US 7,765,850 B2
(45) Date of Patent: Aug. 3, 2010

(54) MECHANICAL PIPE-END EXPANDER AND A METHOD OF MANUFACTURING SEAMLESS STEEL PIPE

(75) Inventors: Tsutomu Arita, Wakayama (JP); Masayoshi Akiyama, Kobe (JP); Kouichi Kuroda, Takatsuki (JP); Tatsuya Okui, Amagasaki (JP)

(73) Assignee: Sumitomo Metal Industries, Ltd., Osaka (JP)

( * ) Notice: Subject to any disclaimer, the term of this patent is extended or adjusted under 35 U.S.C. 154(b) by 0 days.

(21) Appl. No.: 12/230,892

(22) Filed: Sep. 8, 2008

(65) Prior Publication Data

US 2009/0038366 A1 Feb. 12, 2009

Related U.S. Application Data

(63) Continuation of application No. PCT/JP2007/054695, filed on Mar. 9, 2007.

(30) Foreign Application Priority Data

Mar. 9, 2006 (JP) ..... 2006-064668

(51) Int. Cl.
*B21D 41/02* (2006.01)
*B21D 39/20* (2006.01)
*B21D 39/08* (2006.01)

(52) U.S. Cl. ..... 72/393; 72/370.08; 72/370.1

(58) Field of Classification Search ..... 72/393, 72/370.01, 370.03, 370.06, 370.07, 370.08, 72/370.1, 370.13, 392, 283
See application file for complete search history.

(56) References Cited

U.S. PATENT DOCUMENTS

| | | | | |
|---|---|---|---|---|
| 3,385,087 | A * | 5/1968 | Huth | 72/31.06 |
| 3,466,920 | A * | 9/1969 | Parker | 72/393 |
| 4,308,736 | A * | 1/1982 | Lowe et al. | 72/31.06 |
| 7,225,660 | B1 * | 6/2007 | Ledebur | 72/393 |

FOREIGN PATENT DOCUMENTS

| | | |
|---|---|---|
| JP | 59-501197 | 7/1984 |
| JP | 9-285829 | 11/1997 |
| JP | 2820043 | 8/1998 |
| JP | 2900819 | 3/1999 |

* cited by examiner

*Primary Examiner*—Dana Ross
*Assistant Examiner*—Debra M Sullivan
(74) *Attorney, Agent, or Firm*—Clark & Brody

(57) ABSTRACT

The present invention provides a mechanical pipe-end expander comprising a cone and a die having tapered wedge bodies whose outer radius is larger towards a flangeless end direction from a flange end, wherein a pipe-end zone is expanded by a wedge effect of the die, which results from a procedure that the cone and the die are inserted together into the pipe-end zone to be expanded, and that then only the cone is axially drawn outwards leaving the die within the pipe-end zone. A seamless steel pipe with an expanded pipe-end zone is manufactured by applying a mechanical pipe-end expander comprising a die having tapered wedge bodies whose outer radius is larger towards a flangeless end direction from a flange end. The resulting seamless steel pipe has satisfactory pipe-end dimensional accuracy, and exhibits characteristics with excellent field welding workability.

2 Claims, 2 Drawing Sheets

[Figure 1]
PRIOR ART
(a)
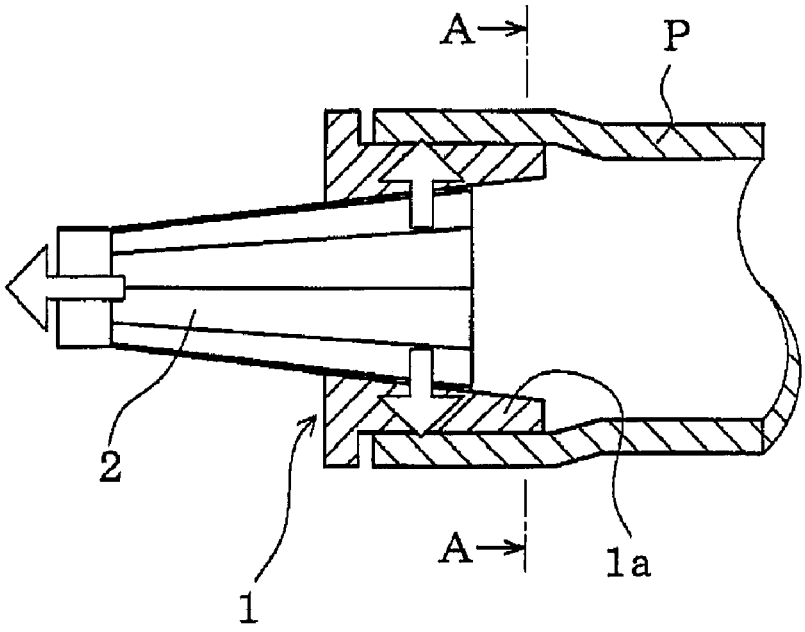
(b)
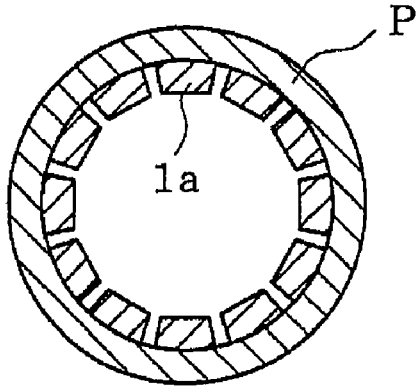

[Figure 2]
PRIOR ART
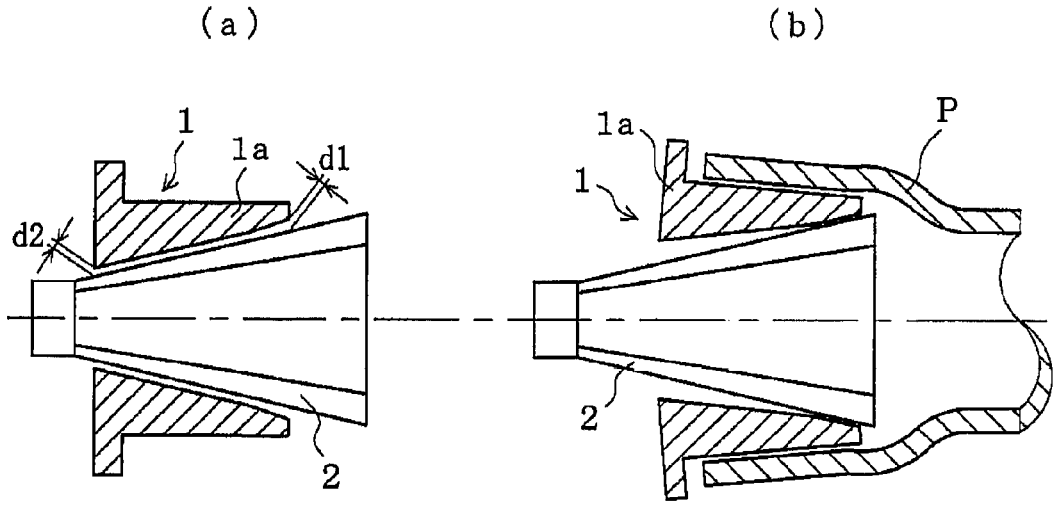
[Figure 3]
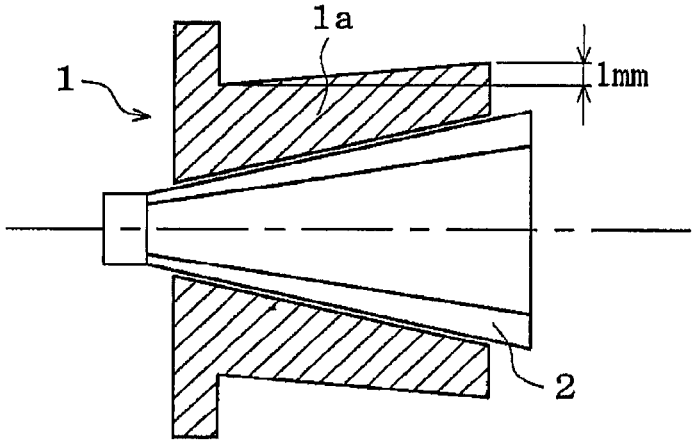

MECHANICAL PIPE-END EXPANDER AND A METHOD OF MANUFACTURING SEAMLESS STEEL PIPE

This application is a continuation of International Patent Application No. PCT/JP2007/054695, filed Mar. 9, 2007. This PCT application was not in English as published under PCT Article 21(2).

FIELD OF THE INVENTION

The present invention relates to a mechanical pipe-end expander, which is applied for a seamless steel pipe to be used in a pipeline for transporting fluid such as petroleum and natural gas, and a method for manufacturing a seamless steel pipe with an expanded pipe-end zone, which is characterized in applying this mechanical pipe-end expander.

BACKGROUND OF THE INVENTION

The pipeline is laid at a field by bonding steel pipes in series by means of a circumferential welding.

Therefore, the steel pipes require a good welding operability, that is, high welding efficiency with less welding defects.

An inner diameter at a welded pipe requires a high dimensional accuracy, particularly at a pipe-end zone, which is at least 100 mm zone towards a longitudinally deep direction from a pipe-end, preferably at 300 mm zone towards a longitudinally deep direction from a pipe-end. Because, if a welding defect is detected after circumferential welding, a tip of the pipe-end zone is cut off, and then a new tip of the pipe-end for the line pipes is circumferentially welded again.

It may be difficult for a hot-worked seamless steel pipe to ensure an inner diameter dimensional accuracy with a narrow tolerance, which affects more on the welding workability compared with a cold-worked welded steel pipe. For ensuring an inner diameter dimensional accuracy particularly at the pipe-end zone, a correction using a grinder or cutter and a correction by cold working has been generally adopted.

It is disclosed in Patent Document 1 that the inner diameter of the pipe-end zone is corrected by inserting a plug having a cylindrical body. It is also disclosed in Patent Document 2 that the material of a pipe expansion die is substituted with a synthetic resin so that pipe expansion is performed with elasticity of a die segment.

[Patent Document 1] Japanese Patent No. 2820043

[Patent Document 2] Japanese Patent No. 2900819

However, the correction using the grinder or cutter may cause reduction in strength at a weld bonding between both of steel pipes since the thickness of the pipe-end zone is reduced. In addition, the correction using the grinder does not result in a uniform correction towards a longitudinally deep direction from a pipe-end.

The techniques disclosed in Patent Documents 1 and 2 do not reduce the thickness of the pipe-end zone. But, they do not result in a uniform pipe expansion towards a longitudinally deep direction from a pipe-end, because a cylindrical body of a die or a plug has the same outer diameter as described below. In addition, the technique disclosed in Patent Document 1 requires many sizes of plugs for responding to various diameters of pipes, which results in an increased manufacturing cost.

The prior technology for improving an inner diameter dimensional accuracy at a pipe-end zone of a hot-worked seamless steel pipe causes a reduction in strength and does not result in a uniform pipe expansion towards a longitudinally deep direction from a pipe-end.

SUMMARY OF THE INVENTION

An objective of the present invention is to improve an inner diameter dimensional accuracy at a pipe-end zone of a hot-worked seamless steel pipe.

The present invention relates to a mechanical pipe-end expander comprising a cone, and a hollow die having a first end and a second end, the first end adapted to be inserted in a pipe end portion of a steel pipe for pipe expansion, wherein the hollow die is circumferentially dividable into a plurality of tapered wedge bodies and a taper angle of an inner surface of the hollow die is the same as a taper angle of an outer surface of the cone, wherein an inner radius of the hollow die is larger in a direction from the second end to the first end of hollow die, and an outer radius of a part of the hollow die adapted to be inserted into a pipe-end portion to be expanded is larger in a direction from the second end to the first end of the hollow die, and wherein the cone is adapted to be inserted into the pipe-end portion to be expanded, the tapered wedge bodies of the hollow die adapted to surround the cone once inserted into the pipe end portion; and the cone is adapted to be axially drawn out of the pipe-end portion leaving the hollow die within the pipe-end portion and causing enlargement of a radius of the hollow die.

The present invention also relates to a method for manufacturing a seamless steel pipe with an expanded pipe-end portion, using a mechanical expander comprising a cone and a hollow die having first and second ends, the first end adapted to be inserted in a pipe end portion of a steel pipe for pipe expansion, wherein the hollow die is circumferentially dividable into a plurality of tapered wedge bodies and a taper angle of an inner surface of the hollow die is the same as a taper angle of an outer surface of the cone, and wherein the inner radius of the hollow die is larger in a direction from the second end to the first end of hollow die and an outer radius of a part of the hollow die to be inserted into the pipe-end portion to be expanded is larger in a direction from the second end to the first end of the hollow die, the method comprising the steps of:

(1) inserting the cone into the pipe end portion of the steel pipe to be expanded, (2) inserting the first end of the hollow die with each of the tapered wedge bodies into the pipe end portion of the steel pipe such that the tapered wedge bodies surround the cone, and (3) drawing the cone axially out of the steel pipe while leaving the hollow die within the steel pipe to push out the hollow die radially and expand the pipe end portion of the steel pipe.

In the present invention, a preferable taper value of the outer radius of the wedge body is determined based on experimental results by the present inventors described below.

BRIEF DESCRIPTION OF THE DRAWINGS

FIG. 1 schematically illustrates a conventional mechanical expander, wherein (a) is a vertically cross-sectional view of an essential part thereof, and (b) is a cross-sectional view taken along line A-A of FIG. 1(*a*);

FIG. 2 illustrates the conventional mechanical expander, wherein (a) is a view illustrating a clearance caused between a die and a cone, (b) is a view illustrating inclination of the die caused by radial abrasion of the wedge body at a flangeless end; and FIG. 3 is an illustrative view of a mechanical pipe-end expander according to the present invention.

BEST MODE FOR CARRYING OUT THE INVENTION

The present invention presents a seamless steel pipe with a satisfactory dimensional accuracy at a pipe-end zone, which exhibits an excellent field welding workability in bonding steel pipes by circumferential welding at a field.

Some findings for the inventors to solve the problem above-mentioned and a best mode for carrying out the present invention will be described in detail using the accompanying drawings.

The pipe expansion technique by plug insertion as disclosed in Patent Document 1 requires many sizes of plugs for correcting various diameters of steel pipes, which results in an increased manufacturing cost.

The present inventors conceived that a mechanical expander capable of expanding various diameters for a UOE steel pipe could be applied to expand only a pipe-end zone for a seamless steel pipe, although the mechanical expander for a UOE steel pipe is applied over the whole length of the UOE steel pipe.

This mechanical expander for a UOE steel pipe comprises, as shown in FIG. 1, a die 1 that is inserted into a steel pipe P to be expanded and a cone 2 that can radially push the die 1 out.

The die 1 is circumferentially divided into a plurality of wedge pieces having a tapered wedge body 1*a* whose outer radius is constant and whose inner radius is larger towards a flangeless end direction from a flange end, wherein an outer surface of the tapered wedge body contacts an inner surface of the steel pipe P and an inner surface of the tapered wedge body contacts an outer surface of the cone 2.

On the other hand, an outer surface of the cone 2 has the same taper angle as the inner surface of the die 1 whose inner radius is larger towards a flangeless end direction from a flange end.

Expansion of the steel pipe P using this mechanical expander can be performed as follows.

The cone 2 is firstly inserted into an end zone of the steel pipe P, and then each of the wedge bodies 1*a* of the die 1 is inserted into the end zone of the steel pipe P.

Then, the cone 2 is axially drawn out of the pipe leaving the die 1 within the steel pipe P. The die 1 is radially pushed out by a wedge effect caused by both the tapers of the cone 2 and the die 1 while the cone 2 is axially drawn out.

Therefore, since an expansion extent of the steel pipe P caused by the die 1 can be controlled by a drawing extent of the cone 2, the steel pipe P can be expanded to various inner diameters using this mechanical expander for a UOE steel pipe.

The present inventors tried to apply this mechanical expander to only a pipe-end zone of a seamless steel pipe. As a result, an inner diameter of the tip of the pipe-end zone could be controlled within a tolerance of a predetermined range, however, an inner diameter of the pipe-end zone was smaller towards a longitudinally deep direction from a pipe-end.

The present inventors noticed that, in order to ensure a longitudinally uniform inner diameter in a pipe-end zone, the pipe expansion must be finished to work in a state where the axis of the pipe-end zone is in parallel to a working surface during a pipe expansion. In other words, an outer surface of the wedge body of the die that contacts the inner surface of the pipe-end zone must be in parallel to the axis of the pipe-end zone when the pipe expansion finishes.

However, because of a constraint by a non-expanded part of the steel pipe P, the pipe expansion only to the pipe-end zone causes a surface pressure on the die 1 higher towards a flangeless end direction from a flange end. Therefore, a pipe expansion only to a pipe-end zone causes a larger abrasion loss towards a flangeless end direction from a flange end at the inner surface of the wedge body 1*a* that contacts a cone, and the clearance between the wedge body 1*a* and the cone 2 consequently becomes larger towards a flangeless end direction from a flange end (refer to FIG. 2(*a*)).

Namely, since a clearance d1 between the cone 2 and the wedge body 1*a* at a flangeless end is larger than a clearance d2 between the cone 2 and the wedge body 1*a* at a flange end, and the surface pressure on the die 1 is higher towards a flangeless end direction from a flange end, the die 1 is inclined to the pipe axis as shown in FIG. 2(*b*) when a pipe expansion finishes. Consequently, the inner diameter of the pipe-end zone of the steel pipe P becomes smaller towards a longitudinally deep direction from a pipe-end.

In the case of a UOE steel pipe, this problem is never caused since a mechanical expander is applied over the whole length of the pipe including pipe-end zones.

The present inventors made various studies and experiments based on the above-mentioned knowledge, and improved a form of wedge pieces constituting a die such that the work can be completed in a state where the working surface is in parallel to the pipe axis even if abrasion of the die is progressed.

An example of the experimental results made by the present inventors is shown as follows.

A steel pipe having an outer diameter of 323.9 mm and a thickness of 25.4 mm was used for the experiment.

Three kinds of mechanical pipe-end expanders were applied to expand a pipe-end zone of this steel pipe. The first expander comprises a die that is circumferentially divided to a plurality of wedge pieces having a single-tapered wedge body whose outer radius is constant, that is, 0.0 mm difference within the outer radius of the wedge body. The second expander comprises a die that is circumferentially divided to a plurality of wedge pieces having a double-tapered wedge body whose outer radius is larger by 0.5 mm along an outer axial length of 100 mm towards a flangeless end direction from a flange end, that is, a 0.5 mm difference exists within the outer radius of the wedge body. The third expander comprises a die that is circumferentially divided to a plurality of wedge pieces having a double-tapered wedge body whose outer radius is larger by 1.0 mm along an outer axial length of 100 mm towards a flangeless end direction from a flange end, that is, a 1.0 mm difference exists within the outer radius of the wedge body.

A radial abrasion of 0.5 mm was caused on the flangeless end of the inner surface of each of the die.

After correcting the pipe-end zone using each die, an outer diameter and a thickness of each expanded zone were measured and an inner diameter was calculated at the pipe-end and at 100 mm apart from pipe-end in order to evaluate the difference within the inner radius of the pipe-end zone that has a length of 100 mm. The result is shown in Table 1.

TABLE 1

| Difference within the outer radius of wedge body (mm) | At pipe-end Outer diameter (mm) ODa | At pipe-end Thickness (mm) WTa | At pipe-end Inner diameter (mm) IDa | At 100 mm apart from pipe-end Outer diameter (mm) ODb | At 100 mm apart from pipe-end Thickness (mm) WTb | At 100 mm apart from pipe-end Inner diameter (mm) IDb | Difference within the inner radius of pipe-end zone (mm) (IDa − IDb)/2 |
|---|---|---|---|---|---|---|---|
| 0 | 326.24 | 25.48 | 275.28 | 325.22 | 25.39 | 274.44 | 0.42 |
| 0.5 | 326.26 | 25.33 | 275.60 | 326.31 | 25.31 | 275.69 | −0.05 |
| 1.0 | 326.22 | 25.12 | 275.98 | 327.26 | 25.20 | 276.86 | −0.44 |

As is shown in Table 1, each value obtained by subtracting the difference within the outer radius of a wedge body (0.0 mm, 0.5 mm, 1.0 mm: each) from the radial abrasion loss (0.5 mm: all) of each die equals almost to each value of the difference within the inner radius of pipe-end zone that has a length of 100 mm (+0.42 mm, −0.05 mm, −0.44 mm: each).

Not more than a 2 mm difference within the inner diameter of pipe-end zone, namely, not more than a 1 mm difference within the inner radius of pipe-end zone, would not cause a serious problem during welding. Therefore, a 1 mm difference within the inner radius of pipe-end zone (outer tapering of 2/100 when the outer length of the wedge body is 100 mm) can lead to not more than a 1.0 mm difference within the inner radius of pipe-end zone that has a length of 100 mm if the radial abrasion loss is not more than 2 mm.

In other words, an expander comprising a die having a double-tapered wedge body whose outer radius is larger by 1.0 mm along an outer axial length of 100 mm towards a flangeless end direction from a flange end (outer tapering of 2/100) can be applied to correct a pipe-end zone of 100 mm (refer to FIG. 3). And, an expander comprising a die having a double-tapered wedge body whose outer radius is larger by 1.0 mm along an outer axial length of 300 mm towards a flangeless end direction from a flange end (outer tapering of 2/300) can be applied to correct a pipe-end zone of 300 mm (refer to FIG. 3).

Such a mechanical pipe-end expander comprising a die 1 can lead to a pipe-end zone whose inner radius of pipe-end is 1 mm larger towards a longitudinally deep direction from a pipe-end at the start of applying the die. Consequently, even if radial abrasion of the die is progressed, the variation within the inner radius of the pipe-end zone can be more reduced, compared with that in a conventional tool. Therefore, a pipe expansion can be executed as long as it is within a tolerance, and the tool life can be largely extended.

As mentioned above, not more than a 2 mm difference within the inner diameter of pipe-end zone, namely, not more than a 1 mm difference within the inner radius of pipe-end zone, would not cause a serious problem during welding. Therefore, a 0.5 to 1.5 mm difference within the outer radius of the wedge body (outer tapering of 1/100 to 3/100 when the outer length of the wedge body is 100 mm) can lead to not more than a 1.5 mm difference within the inner radius of pipe-end zone that has a length of 100 mm if the radial abrasion loss is not more than 2 mm.

The present invention is never limited by the above-mentioned embodiment, and modifications thereof obviously can be made within the scope of the technical ideas described in each claim.

The invention claimed is:

1. A mechanical pipe-end expander comprising:

a cone, and a hollow die having a first end and a second end, the first end adapted to be inserted in a pipe end portion of a steel pipe for pipe expansion, wherein the hollow die is circumferentially dividable into a plurality of tapered wedge bodies and a taper angle of an inner surface of the hollow die is the same as a taper angle of an outer surface of the cone, wherein an inner radius of the hollow die is larger in a direction from the second end to the first end of hollow die, and an outer radius of a part of the hollow die adapted to be inserted into the pipe-end portion to be expanded is larger in a direction from the second end to the first end of the hollow die, and wherein the cone is adapted to be inserted into the pipe-end portion to be expanded, the tapered wedge bodies of the hollow die adapted to surround the cone once inserted into the pipe end portion; and the cone is adapted to be axially drawn out of the pipe-end portion leaving the hollow die within the pipe-end portion and causing enlargement of a radius of the hollow die.

2. A method for manufacturing a seamless steel pipe with an expanded pipe-end portion, using a mechanical expander comprising a cone and a hollow die having first and second ends, the first end adapted to be inserted in a pipe end portion of a steel pipe for pipe expansion, wherein the hollow die is circumferentially dividable into a plurality of tapered wedge bodies and a taper angle of an inner surface of the hollow die is the same as a taper angle of an outer surface of the cone, and wherein the inner radius of the hollow die is larger in a direction from the second end to the first end of hollow die and an outer radius of a part of the hollow die to be inserted into the pipe-end portion to be expanded is larger in a direction from the second end to the first end of the hollow die, the method comprising the steps of:

(1) inserting the cone into the pipe end portion of the steel pipe to be expanded, (2) inserting the first end of the hollow die with each of the tapered wedge bodies into the pipe end portion of the steel pipe such that the tapered wedge bodies surround the cone, and (3) drawing the cone axially out of the steel pipe while leaving the hollow die within the steel pipe to push out the hollow die radially and expand the pipe end portion of the steel pipe.

* * * * *